US008072388B2

(12) United States Patent
Nysen et al.

(10) Patent No.: US 8,072,388 B2
(45) Date of Patent: Dec. 6, 2011

(54) MULTI-MODAL RF DIVERSITY ANTENNA

(75) Inventors: Paul A. Nysen, Pala, CA (US); Todd Van Cleave, San Marcos, CA (US); Daniel George Laramie, Littleton, CO (US); Geoffrey G. Schulteis, Vista, CA (US); Kevin Wolentarski, Encinitas, CA (US)

(73) Assignee: Sierra Wireless, Inc., Richmond, BC (CA)

( * ) Notice: Subject to any disclaimer, the term of this patent is extended or adjusted under 35 U.S.C. 154(b) by 435 days.

(21) Appl. No.: 12/209,198

(22) Filed: Sep. 11, 2008

(65) Prior Publication Data

US 2009/0224984 A1 Sep. 10, 2009

Related U.S. Application Data

(60) Provisional application No. 60/993,686, filed on Sep. 12, 2007.

(51) Int. Cl.
*H01Q 21/10* (2006.01)
*H01Q 1/24* (2006.01)

(52) U.S. Cl. ..... 343/810; 343/702; 343/793; 343/895

(58) Field of Classification Search ..... None
See application file for complete search history.

(56) References Cited

U.S. PATENT DOCUMENTS

| | | | | |
|---|---|---|---|---|
| 7,053,843 | B2 | 5/2006 | Nysen | |
| 7,183,994 | B2 | 2/2007 | Weigand | |
| 7,683,839 | B2 * | 3/2010 | Ollikainen et al. | 343/702 |
| 7,696,932 | B2 * | 4/2010 | Desclos et al. | 343/702 |
| 2002/0101377 | A1 * | 8/2002 | Crawford | 343/702 |
| 2002/0149527 | A1 * | 10/2002 | Wen et al. | 343/727 |
| 2008/0018543 | A1 * | 1/2008 | Baliarda et al. | 343/702 |
| 2009/0115670 | A1 * | 5/2009 | Nysen | 343/702 |
| 2009/0278759 | A1 * | 11/2009 | Moon et al. | 343/810 |

FOREIGN PATENT DOCUMENTS

WO W02004/047222 6/2004

OTHER PUBLICATIONS

International Search Report for PCT/US2008/076270 dated Dec. 1, 2008.

* cited by examiner

*Primary Examiner* — Trinh Dinh
(74) *Attorney, Agent, or Firm* — Nixon Peabody LLP

(57) ABSTRACT

A dual-band diversity antenna includes a ground plane and a main antenna system coupled to the ground plane, the main antenna system being a dipole having a primary dipole axis directed along the longitudinal axis of the wireless communication device, and a diversity antenna system coupled to the ground plane, the diversity antenna system being a monopole having an primary axis directed along the longitudinal axis of the wireless communication device.

30 Claims, 7 Drawing Sheets

MULTI-MODAL RF DIVERSITY ANTENNA

CROSS REFERENCE TO RELATED APPLICATIONS

This application claims the benefit of U.S. Provisional Patent Application No. 60/993,686, filed on Sep. 12, 2007, entitled "Multi Modal RF Diversity Antenna System Using Complex Coupling", the disclosure of which is hereby incorporated by reference for all purposes.

TECHNICAL FIELD

The invention relates to antennas for use with portable and other computing devices, such as laptop computers. More specifically, it relates to antennas that may be part of removable components such as PC cards like PCMCIA (personal computer memory card international association) cards that provide wireless communication to the computing devices.

BACKGROUND

Some computing devices, such as laptop computers, may be manufactured without wireless communication capability. Rather, they are provided with slots or similar coupling expedients into which wireless communication devices may be mated to provide the host computing device with wireless capability. The wireless communication device, referred to herein as a PC card, can be for example a PCMCIA (personal computer memory card international association) type card, and can include a transceiver and other circuitry coupled to an antenna and matable with the host device to provide wireless communication capability thereto.

FIG. 1 is an isometric view of a laptop computer 100 configured to receive a PC card 102 in a slot 104 provided in a side face 106 of the laptop computer. When inserted into the slot 104, PC card 102 makes electrical connections with the laptop computer to provide wireless communication capability thereto. PC card 102 can be considered as having two main modules—RF (radio frequency) system module 102*a* and antenna module 102*b*. RF system module 102*a* houses the active electronic components (not shown), such as amplifiers, modems, controllers, transceivers, and so forth, while antenna module 102*b* houses the one or more antennas and their related devices (not shown), possibly including matching and shunting components, couplings, feedlines, ground planes, and so forth. In the view of FIG. 1, side face 106 and slot 104 extend generally in the X direction. PC card 102 has a transverse axis (not shown) also extending in the X direction, and a longitudinal axis (not shown) extending in the Y direction. The PC card 102 is moved in the direction of its longitudinal axis, as depicted by double-headed arrow c, for coupling to or uncoupling from the laptop computer 100. The coupling is effected by way of a connector array 108. Modules 102*a* and 102*b* are generally disposed along the longitudinal axis relative to one another.

Many different types of antennas can be used with wireless communication devices such as PC card 102. Diversity antennas are very beneficial for improving the quality of the received signal in a wireless communications receiver. Typical diversity antenna systems consist of a main antenna and a diversity antenna, although there could be more than one diversity antenna. In the example of FIG. 1, the main and diversity antennas would generally be housed in antenna module 102*b* of PC card 102.

One benefit of diversity in such a system comes from the de-correlation of the fading between two separate antenna systems. The antennas can be spatially separated and/or use orthogonal or other dissimilar polarizations (i.e. vertical and horizontal polarizations, right and left circular polarization, etc.) During a fade, the signal strength is degraded to the point that long error bursts occur in the received signal, degrading the overall received radio throughput, among other degradations. Diversity helps alleviate this problem by having two antennas separated in space and/or polarization, providing two nearly independent receive signal channels or paths which do not experience fades in the same way (that is, they are de-correlated, or exhibit orthogonality). Thus while one antenna may experience a deep fade the other antenna may be within 3 dB of its nominal signal level. The result of this is that links with rapid fading that can go −15 dB or more below the average signal strength in a fade on a single channel system (non-diversity) but may be reduced to only −4 dB or −5 dB below the average signal strength with diversity on a statistical basis. In this example, diversity would provide an effective gain of 11 dB to 10 dB. Thus the reduced loss of signal prevents the channel from being dropped far less frequently than it would with a single deep fading channel. The diversity antenna may be separated by as little as one eighth of a wavelength and still experience a significant gain over a single channel non-diversity antenna.

Diversity antenna systems for use in high volume applications are demanding ever decreasing costs in integration and assembly. Reduction in the interconnect costs and simplification by integration and the elimination of discrete components is also a major cost reduction goal. Size reduction, while maintaining reasonable RF efficiency and isolation, is also a rigorous requirement.

For many wireless technologies, a diversity antenna is desired to be included in a very small volume where the main antenna resides, without excessive electromagnetic coupling to the main antenna. As explained above, one aim of the diversity antenna concept is to provide reception of the signal when the main antenna is situated in an area of signal cancellation due to "multi-path," or "fading" of the signal, but the diversity antenna must not be electromagnetically coupled to the main antenna—that is, it must have a level of isolation, to meet requirements of the wireless network which electronically switch from the main signal path to the diversity signal path, depending on which path offers the better signal reception. Another reason for an isolation requirement may be to protect the diversity receiver front end components from excessive power transmitted from the main antenna. As such, one of the difficulties is to design a diversity antenna that receives the same frequency bands as the main antenna, but does not lose the received signal into the main antenna (which may be instantaneously turned off in favor of the diversity channel), instead directing the signal into the diversity channel of the radio, and not receiving excessive signal energy being transmitted by the same radio through the main antenna. The diversity antenna is intended to couple into a signal field polarization, or signal field location, that is not available to the main antenna. It is thus desired to have different antenna polarizations, antenna locations or antenna radiation patterns, or any combination of these, for the main and diversity antennas, while meeting the requirements of the overall antenna system such as size, cost, electrical performance, appearance, weight, or any other requirements specific to the application.

OVERVIEW

As disclosed herein, a dual-band diversity antenna includes a ground plane and a first antenna system coupled to the ground plane and including elements that are configured as a half-wave dipole for operation in a high band as a high band main antenna, the high band main antenna being configured for driving in a differential mode and including a reflector element, the first antenna system further including elements that are configured as a dipole for operation in a low band as a low band main antenna, the low band main antenna being configured for driving in a differential mode and including a quarter-wave structure to which the low band main antenna dipole is coupled. The dual-band diversity antenna includes also a second antenna system coupled to the ground plane and including elements that are configured as a dipole for operation in a high band as a high band diversity antenna, the high band diversity antenna being configured for driving in a common mode, the second antenna system further including elements that are configured as a dipole for operation in a low band as a low band diversity antenna, the low band diversity antenna having the ground plane as a counterpoise.

Also as disclosed herein, a dual-band diversity antenna includes a ground plane, a main antenna system coupled to the ground plane, the main antenna system being a dipole having a primary dipole axis directed along the longitudinal axis of the wireless communication device, and a diversity antenna system coupled to the ground plane, the diversity antenna system being a monopole having an primary axis directed along the longitudinal axis of the wireless communication device.

BRIEF DESCRIPTION OF THE DRAWINGS

The accompanying drawings, which are incorporated into and constitute a part of this specification, illustrate one or more examples of embodiments and, together with the description of example embodiments, serve to explain the principles and implementations of the embodiments.

In the drawings.

DESCRIPTION OF EXAMPLE EMBODIMENTS

Example embodiments are described herein in the context of a diversity antenna and pc card in which it is used. Those of ordinary skill in the art will realize that the following description is illustrative only and is not intended to be in any way limiting. Other embodiments will readily suggest themselves to such skilled persons having the benefit of this disclosure. Reference will now be made in detail to implementations of the example embodiments as illustrated in the accompanying drawings. The same reference indicators will be used to the extent possible throughout the drawings and the following description to refer to the same or like items.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

In the example set forth in the following description, dual-band operation is described, primarily in terms of a high PCS (personal communications service) and a low cellular frequency band, recognized to be about 1.85 to 1.99 GHz for PCS and about 824 to 894 MHz for cellular. To some extent, GPS band operation—which is a mid-band example falling between the low and high bands—is also accommodated. It will be appreciated, however, that the invention is not limited to these bands as the same principles apply to other bands. The specific design disclosed herein can readily be adapted by those of ordinary skill in the art to other operational bands, especially if the high and low bands are nominally about one-and-a-half to two-and-a-half octaves apart. Other bands for which the principles of the invention are applicable include combinations of UMTS (universal mobile telecommunications system), GSM (global system for mobile communications) and GPS (global positioning system), for example.

Further, while described herein in terms of a laptop computer as the host device, and a PCMCIA card as the wireless communication device, it will be appreciated that the invention is not so limited, and other host devices, such as PDAs and desktop computers, and other wireless communication devices for establishing wireless communication through a cellular network or through Bluetooth, WiFi, PCS, UMTS, GSM, GPS and other types of wireless links and channels are also contemplated.

Figure 1:
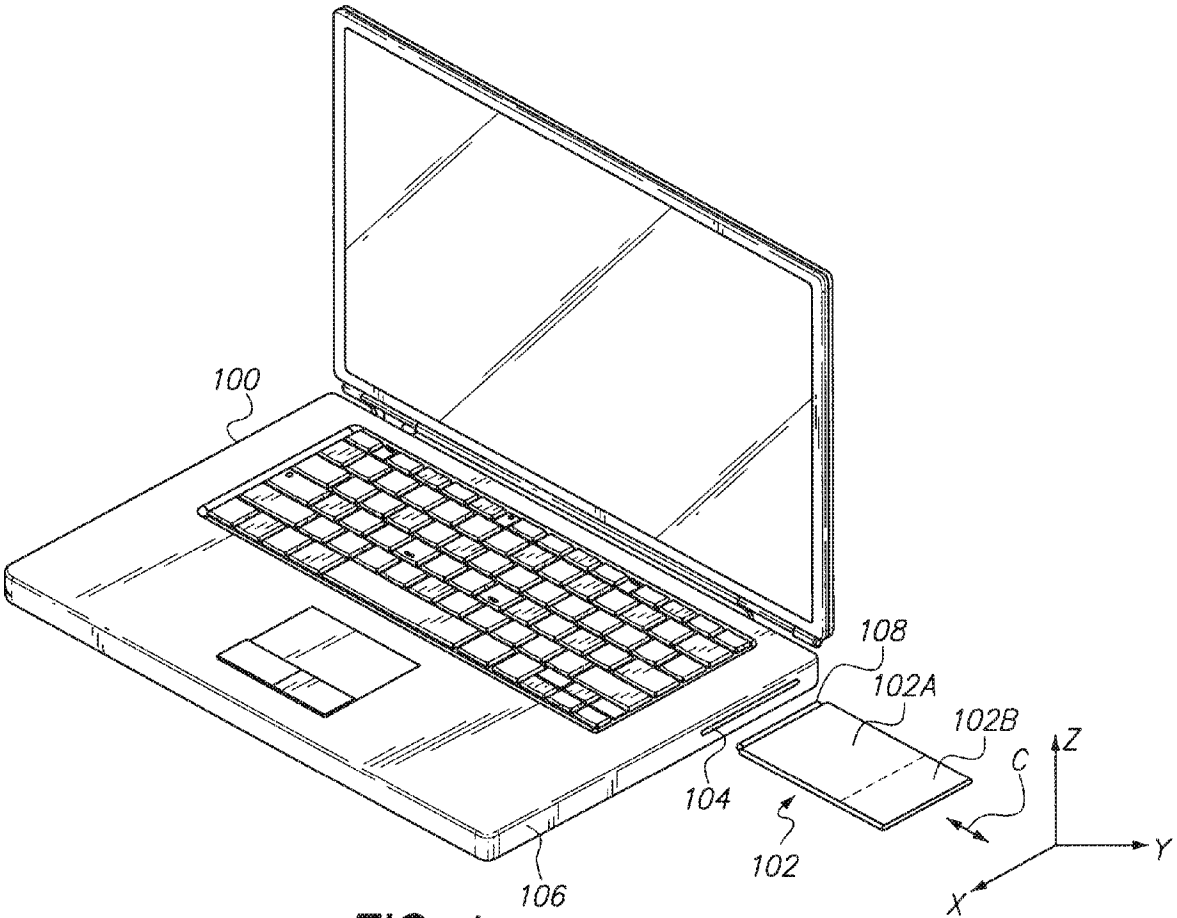
FIG. 1 is diagram showing the use of a wireless communication devices such as PC card with a host device such as a laptop computer.
Figure 2A:
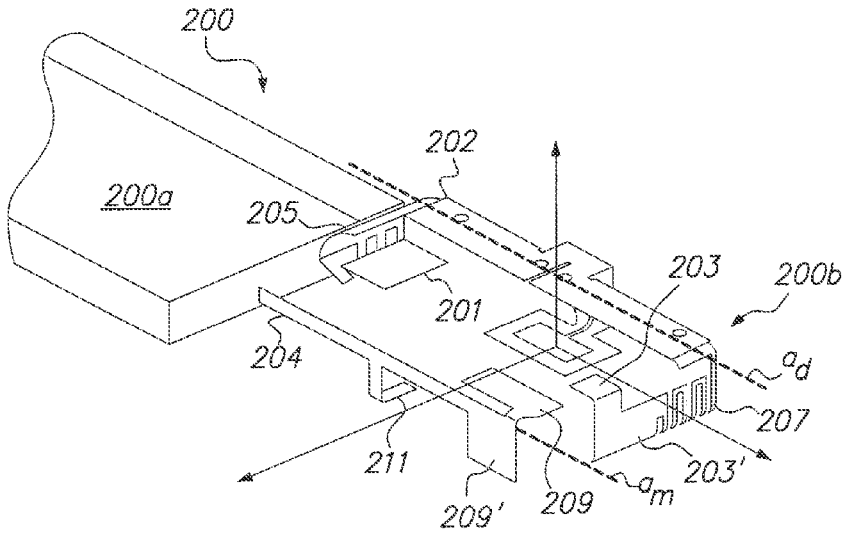
FIGS. 2*a*-2*d* are isometric views of portions of a wireless communication device 200, such as a PC card, showing some details of an antenna module thereof.
Figure 2B:
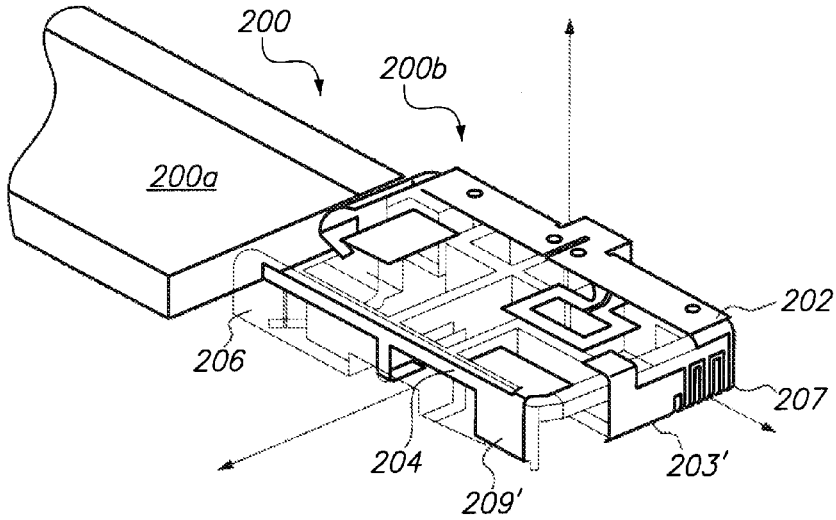
Figure 2C:
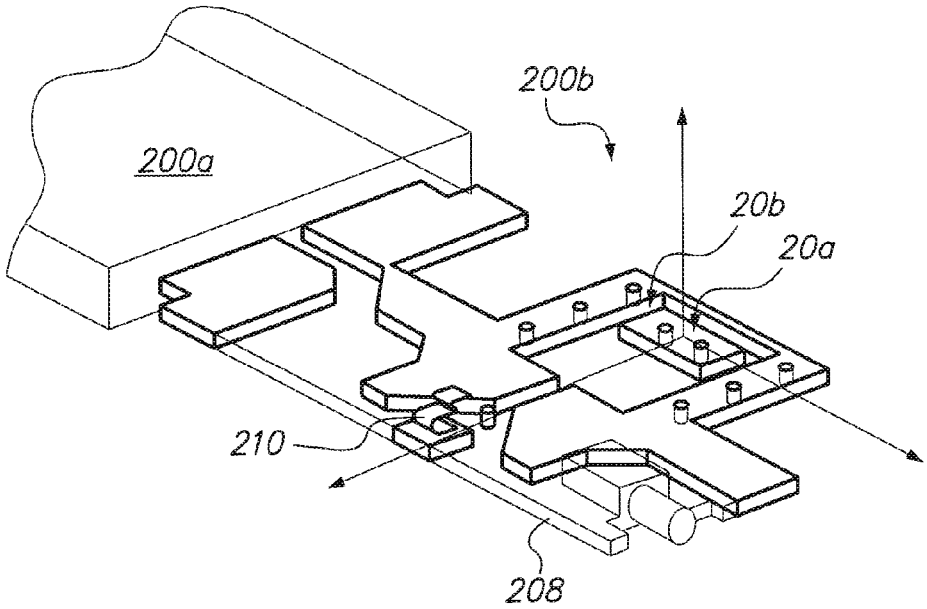

FIGS. 2*a*-2*c* are isometric views of portions of a wireless communication device 200, such as a PC card, showing some details of an antenna module thereof. Device 200 is intended to mate with a laptop computer or the like (not shown) to provide wireless communication capability thereto. Generally, device 200 includes an RF system module 200*a* and an antenna module 200*b*. RF system module 200*a* houses the active electronic components (not shown), which may include amplifiers, modems, controllers, transceivers, and so forth. Antenna module 200*b* includes a main antenna system 202 and a diversity antenna system 204. The main antenna system 202 is configured generally as a balanced dipole antenna oriented with its primary dipole axis $a_d$ (FIG. 2*a*) along the longitudinal axis of the wireless communication device 200—that is, it extends in the Y direction normal (transverse) to the side face and the slot of the laptop (not shown) in which the device 200 is coupled in operation. End-loading of the arms of the dipole is provided by segments 201, 203 and 203', electrically connected to the arms of the dipole by meander lines 205 and 207. Segments 203 and 203' lie in planes that are orthogonal to one another, with segment 203 being in a parallel (or the same) plane as the dipole. Further, segment 203' is in a plane that is orthogonal to that of the main dipole structure.

The diversity antenna system 204 is configured generally as a monopole, also oriented with its primary monopole axis $a_m$ along the longitudinal axis of the wireless communication device 200. End-loading of the monopole is provided by segments 209 and 209', which lie in planes that are orthogonal to one another, with segment 209 being in a parallel (or the same) plane as the monopole. The antenna systems 202 and 204 or portions thereof may be formed on the same FPCB (flexible printed circuit board) (not shown), and supported as necessary by a polymeric (or other material) antenna support system 206, shown in FIG. 2*b*.

Figure 2D:
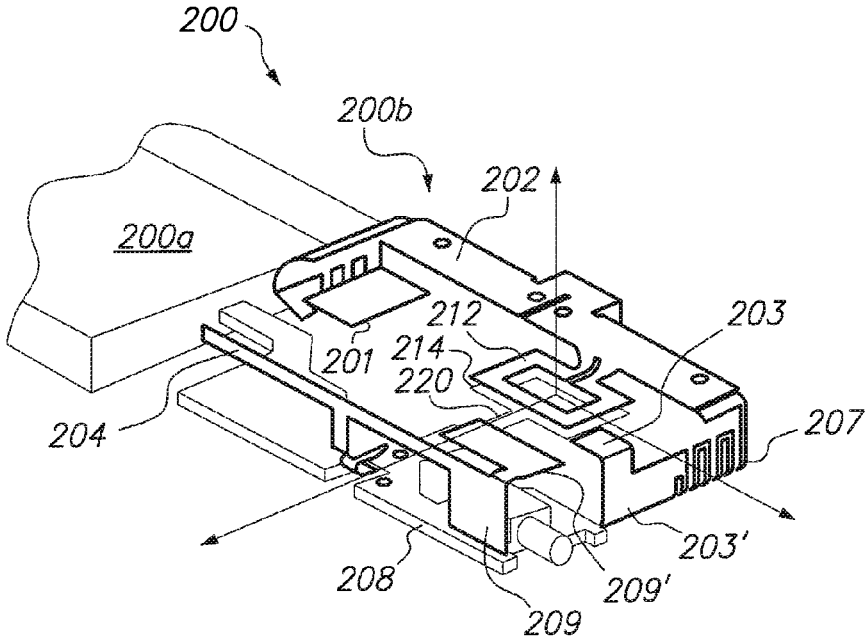

As seen in FIGS. 2*c* and 2*d*, antenna module 200*b* also includes a ground plane 208 extending from RF system module 200*a* and coupled electrically with components (not shown) of the RF system module. A conductive coupling means, for example in the form of a metallic spring clip 210, couples diversity antenna system 204 to ground plane 208. Spring clip 210 contacts diversity antenna system 204 at a tab 211 (FIG. 2*a*) of the diversity antenna system. Coupling between main antenna system 202 and ground plane 208 is by way of an inductive coupling mechanism and a capacitive coupling mechanism, explained with reference to FIG. 2*e*.

Figure 2E:
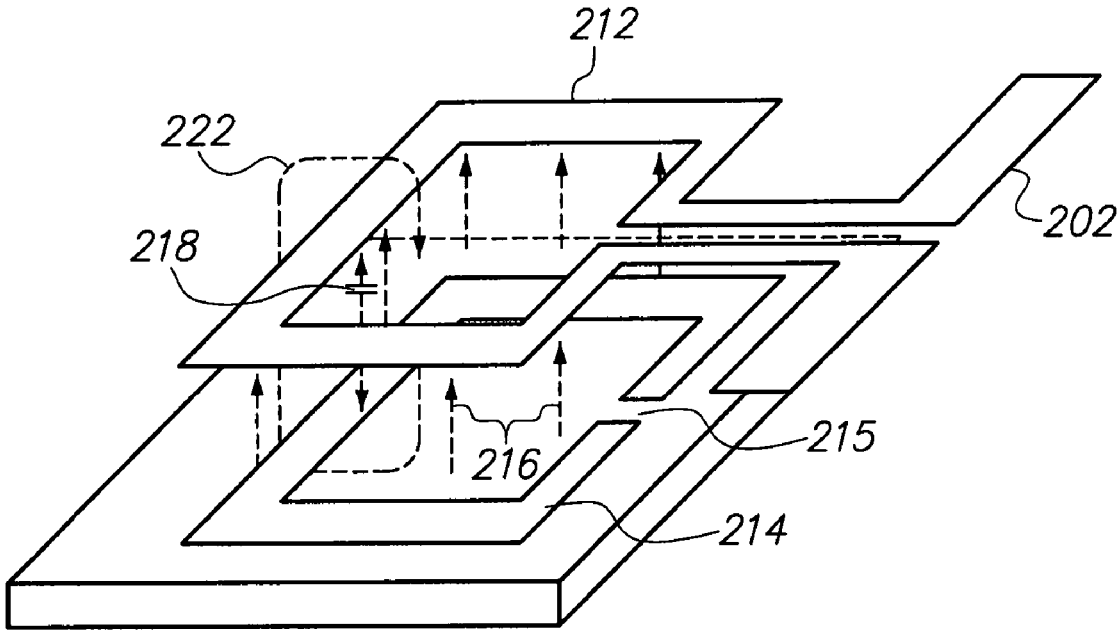
FIG. 2*e* is a schematic view showing an inductive and capacitive coupling scheme.

The use of an inductive coupling mechanism and a capacitive coupling mechanism between main antenna system 202 and ground plane 208 enables broadband RF operation and DC isolation, while dispensing with the need for direct electrical contact, eliminating the cost and complexity associated therewith. As seen in FIG. 2*e*, the capacitive and inductive coupling scheme generally employs two loops 212 and 214, associated respectively with main antenna system 202 and ground plane 208. Loop 214 includes a gap port 215 for differential mode connection to the RF system, for example by way of a stripline or microstrip (not shown) that may include either a short or open circuit-type connection.

The capacitive coupling mode, represented by electric field lines 216, correlates with even mode coupling between the two loops 212 and 214 for the main antenna system 202, as detailed further below. Capacitor 218 schematically illustrates the capacitive coupling mode, with this specific instance of capacitive coupling being referred to herein as capacitive coupling 218. Due to the symmetry on the main antenna system 202, the common, or even, mode of the antenna is effectively originated at the symmetry point where the equivalent capacitor 218 is shown. As best seen in FIG. 2*d*, the location of capacitive coupling 218 between the main antenna system 202 common mode and the ground plane 208 is at a junction of an extension 220 which also furnishes a connective path, by way of spring clip 210, for the diversity monopole antenna system 204. Other capacitive couplings are also established, including for instance capacitive coupling between the ends of the main (202) and diversity (204) antenna systems, as explained below.

The inductive coupling of the loops 212 and 214 is represented by the arrow 222, and correlates to odd mode coupling to the main antenna system 202, as detailed further below. This specific instance of inductive coupling is referred to herein as inductive coupling 222.

Reference is now made to FIGS. 3*a*-3*b*, 4*a*-4*b*, 5*a*-5*b* and 6*a*-6*b*, which schematically illustrate the various modes of operation that can be realized from the above-described antenna configuration(s). It should be noted that while the discussion above was in terms of a main antenna system 202 and a diversity antenna system 204, in actual operation as described hereinbelow, the interaction of these systems with the ground plane and other components is such that primarily dipole operation is realized.

Figure 3A:
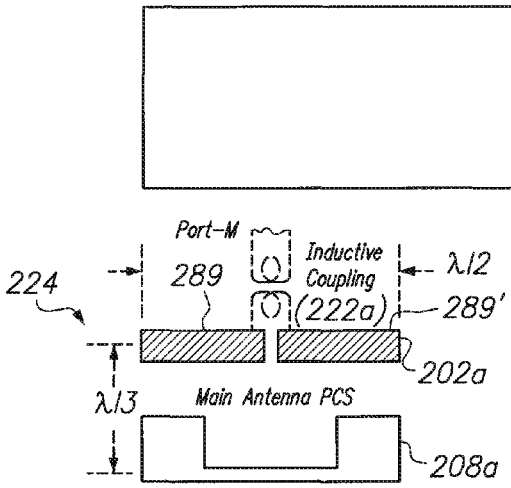
FIGS. 3*a*-3*b* illustrate operation of a main antenna high (PCS) band mode established by the inductive coupling with the main antenna system.
Figure 3B:
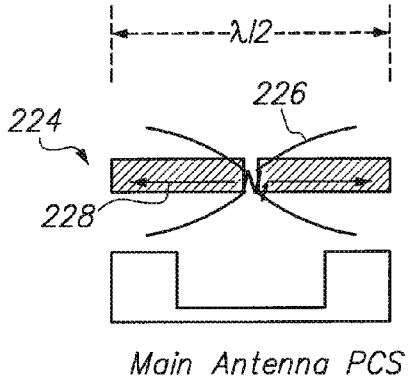

FIGS. 3*a*-3*b* relate to a main antenna high (PCS) band mode established using the inductive coupling with the main antenna system 202. Operation in this case takes the form of a simple half-wave dipole 224 that is coupled by its differential, or odd, mode via the inductive coupling, designated 222*a* for this configuration, in the system main RF path designated Port-M. Schematically, the half-wave dipole 224 is illustrated to include elements 289 and 289'. The ground plane portion 208*a* is spaced approximately one third of a wavelength from the dipole, and serves as a parasitic element to provide directionality and beam reinforcement in the manner of a reflective element of a Yagi-type antenna. Ground plane portion 208*a* also induces some impedance matching alteration for the antenna. While the λ/3 spacing is non-ideal—λ/4 would provide optimum bandwidth—it is a practical solution in view of other constraints imposed by dual-band and diversity system requirements. Also, additional interaction exists with the end-loading (201, 203, 203') of the dipole 224 via the meander lines 205 and 207 (FIG. 2*a*) of the main antenna system 202, and this interaction facilitates GPS (intermediate) band detection by the main antenna system. The result of this operation is the E field voltage standing wave pattern 226 at the driven point or voltage nodal point $N_1$ that is seen in FIG. 3*b*. The E polarization direction 228 is also illustrated, and extends along the major length of the dipole, right-to-left in the plane of the drawing figure page. These resultant electrical characteristics are applicable to the GPS band as well as the high (PCS) band.

Figure 4A:
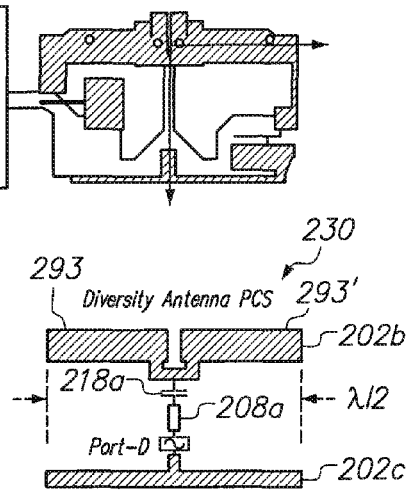
FIGS. 4*a*-4*b* schematically illustrate a high band (PCS) top-loading diversity dipole that is established.
Figure 4B:
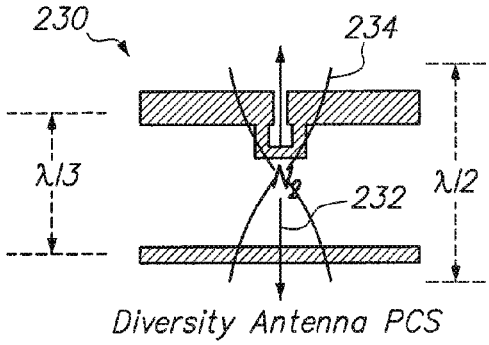

FIGS. 4*a*-4*b* schematically illustrate a high band (PCS) top-loading diversity dipole 230 established using elements including elements 293 and 293'. The top-loading diversity dipole includes two top-loading sections 202*b*, 202*c* that are spaced about a third of wavelength apart and driven in the common or even mode. An interconnection to a diversity port Port-D is provided, and includes a portion 208*b* of the ground plane, along with the capacitive coupling mode designated 218*a*. The resultant polarization from this configuration is shown in FIG. 4*b*, which shows up-down (in the drawing figure) E polarization 232 that is, importantly, orthogonal to the polarization for the high band (PCS) main antenna of the previously-described simple half-wave dipole 224 of FIGS. 3*a*-3*b*. Also shown in FIG. 4*b* is the standing wave 234 at node N2 of this high band diversity dipole 230. Because the main and diversity antennas from this arrangement are orthogonally polarized—that is, substantially at right angles to one another—good isolation (better than about 15 dB) between them is realized in the high band.

Figure 5A:
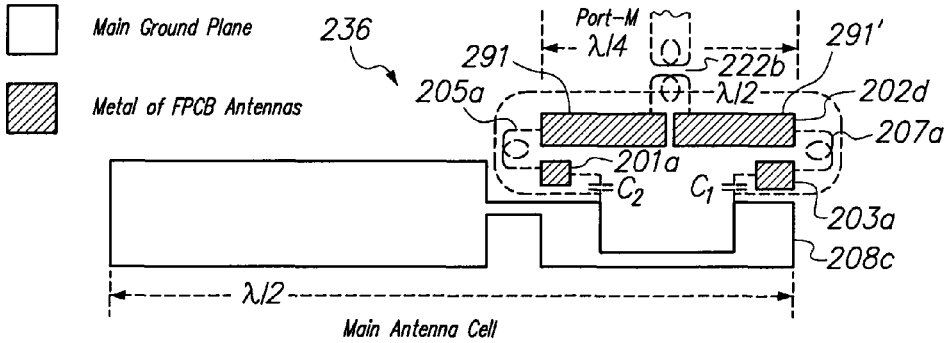
FIGS. 5*a*-5*b* schematically illustrate the establishment of a main antenna low band (cellular) antenna.
Figure 5B:
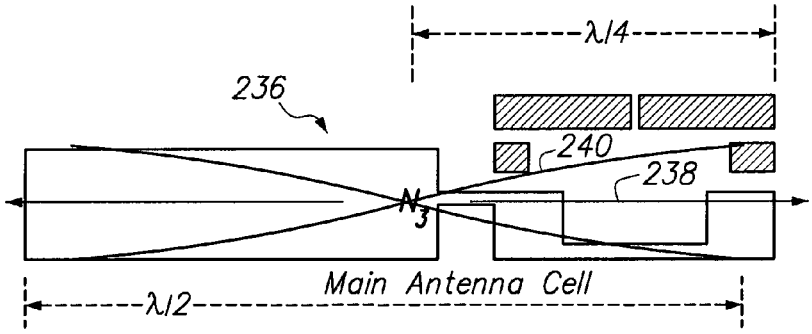

FIGS. 5*a*-5*b* schematically illustrate the establishment of a main antenna low band (cellular) antenna 236 including elements 291, 291'. This dipole antenna is coupled at one end to a quarter-wave structure 202*d* that is end-loaded to smaller end-loading structures 201*a* and 203*a* via meander lines 205*a* and 205*a*, respectively. Further, the quarter-wave structure 202*d* is capacitively-coupled, by way of the end-loading structures 201*a* and 203*a*, to the portion 208*c* of the ground plane. The capacitive coupling is designated fringe capacitors C1 and C2, with C1 generally being the greater capacitance of the two, to thereby achieve asymmetrical capacitive coupling. The quarter-wave structure 202*d* is differentially driven through the loop structure 222*b*, which can take the form of a balun. While fringe capacitance C2 is similar to C1, the first order differential mode in the ground plane 208*c* approaches a voltage node at the location of the capacitive coupling C2. On the other hand, the capacitive coupling C1 is at the voltage maximum of this mode in the ground plane 208*c* and therefore induces excitation of the ground plane into the first order mode using indirect excitation of the end-loaded quarter-wave structure 202*d* driven by the inductive coupling from the RF-system main port Port-M in the manner of the high band antenna discussed above. Thus the high and low band main antennas are configured to be driven from a common port Port-M. In this mode of operation, therefore, the main low band diversity antenna system uses a polarization for main and diversity that is almost like-polarized. The excitation of the ground plane 208*c* by the main path of the RF system results in an effective voltage node at the point N3 which is centered on the half-wavelength of the ground plane. The resulting polarization is shown at 238, and the voltage standing wave is shown at 240.

Figure 6A:
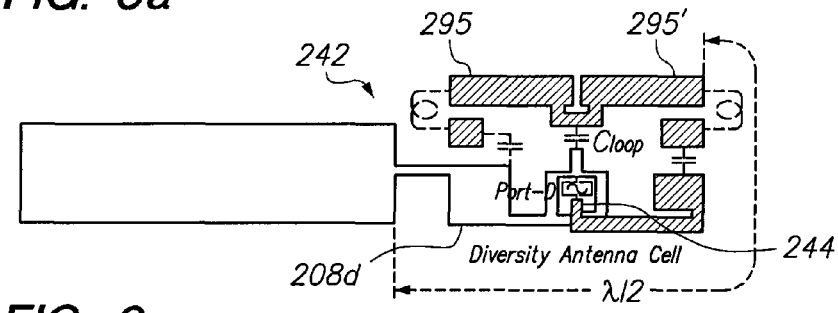
FIGS. 6*a*-6*b* show the establishment of a diversity low band antenna as a dipole structure.
Figure 6B:
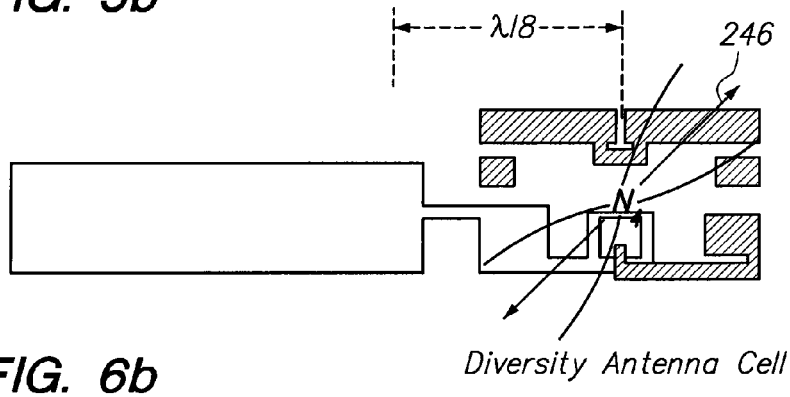

The diversity low band antenna is also established as a dipole structure, designated 242 and described with reference to FIGS. 6*a*-6*b*. The dipole structure 242 includes elements 295 and 295' and uses portion 208*d* of the ground plane. It is excited through antenna element 244 that is in turn driven from the diversity port Port-D, having a counterpoise in the ground plane portion 208*d*. Port-D is thus a common driving point for the high band and low band diversity antennas. The net half wavelength radiating length, designated 248 exhibits dipole-style radiator elements. This is a narrow-band structure, but is sufficient for cellular band diversity purposes. This diversity low band antenna mode thus established uses elements 202*e* and 208*d* to generate the RF field. The effective antenna node N4 is as indicated in FIG. 6*b*, resulting in a slightly off-horizontal polarization designated 246. While the polarizations of the main (236) and diversity (242) antennas in the low band are almost like-polarized, there is an isolation benefit because the nodal points N3 and N4 are spaced longitudinally. In this special instance there is a further benefit due to the short length of the diversity dipole 242, namely a nominal quarter wavelength at the low band frequency, wherein there is a local minimum when the nodal points are separated longitudinally by a nominal one eight wavelength, resulting in an isolation that is better than approximately 10 dB between the two antenna configurations.

Figure 7:
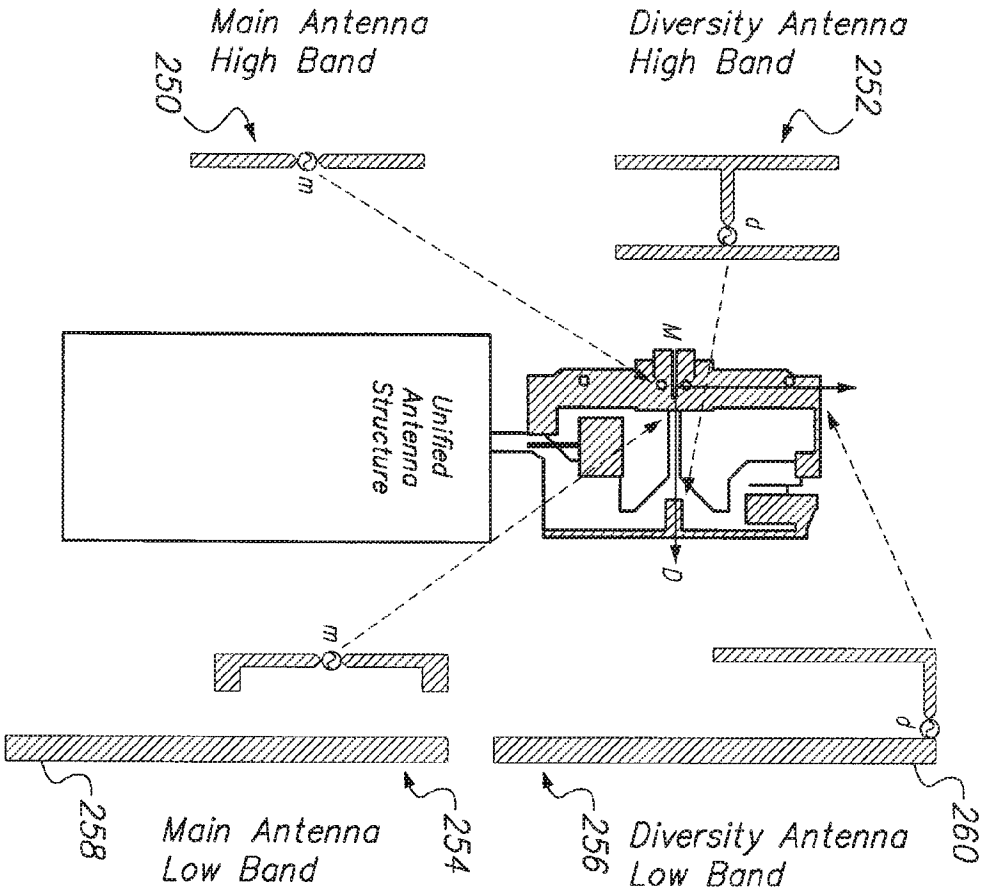
FIG. 7 shows a schematic top view illustrating the layout of the antenna module.

Reference is now made to FIG. 7, to further explain the layout of the antenna module 200*b* as explained above. Generally, FIG. 7 shows 4 dipoles 250, 252, 254 and 256, with the feed locations of the two diversity dipoles 252 and 256 being offset. The offsets are necessitated by the physical constraints of the system and only have a negligible impact on dipole impedance. In addition, the parasitic elements 258 and 260 of the low frequency band dipoles is also offset from conventional configurations. This offset is nominally one eight of a wavelength while the physical length of the dipole for the low band main antenna is quarter of a wavelength (that is, a short Hertzian dipole). While non-offset excitation by a dipole or driven element is fundamental to the well-known Yagi antenna, the use of an offset in this case becomes necessary in order to capitalize on the physical size and other mechanical constraints while still maintaining adequate coupling between the driven element and the parasitic element.

As seen from FIG. 7, each of the individual dipoles is "morphed" into a unified antenna structure. Of particular note is that the two driven points indicated by a lower case "m" for the main antennas are superimposed to become the feed point upper case "M" on the unified antenna structure. Similarly the two driven points "d" for the diversity antennas are superimposed to become the feed point "D". The frequency-selective nature of the elements shown and the means of coupling between these elements described in detail above enables the unified antenna structure to exhibit independently controllable matching and isolation between the high and low bands and between the main and diversity antennas.

While embodiments and applications have been shown and described, it would be apparent to those skilled in the art having the benefit of this disclosure that many more modifications than mentioned above are possible without departing from the inventive concepts disclosed herein. The invention, therefore, is not to be restricted except in the spirit of the appended claims.

What is claimed is:

1. A dual-band diversity antenna comprising:

a ground plane;

a first antenna system coupled to the ground plane and including elements that are configured as a half-wave dipole for operation in a high band as a high band main antenna, the high band main antenna being configured for driving in a differential mode and including a reflector element operative to provide directionality and beam reinforcement, the first antenna system further including elements that are configured as a dipole for operation in a low band as a low band main antenna, the low band main antenna being configured for driving in a differential mode and including a quarter-wave structure to which the low band main antenna dipole is coupled; and a second antenna system coupled to the ground plane and including elements that are configured as a dipole for operation in a high band as a high band diversity antenna, the high band diversity antenna being configured for driving in a common mode, the second antenna system further including elements that are configured as a dipole for operation in a low band as a low band diversity antenna, the low band diversity antenna having the ground plane as a counterpoise.

2. The dual-band diversity antenna of claim 1, wherein the high band main antenna is inductively coupled to the ground plane.

3. The dual-band diversity antenna of claim 1, wherein the quarter-wave structure includes two end-loading structures.

4. The dual-band diversity antenna of claim 3, wherein the end-loading to the two end-loading structures is by way of meander lines.

5. The dual-band diversity antenna of claim 3, wherein the two end-loading structures are capacitively coupled to the ground plane.

6. The dual-band diversity antenna of claim 5, wherein the capacitive coupling is asymmetrical.

7. The dual-band diversity antenna of claim 1, wherein the first antenna system includes a balun through which differential driving of the low band main antenna is effected.

8. The dual-band diversity antenna of claim 1, wherein the high band diversity antenna includes two top-loading sections.

9. The dual-band diversity antenna of claim 8, wherein the two top-loading sections are about a third of a wavelength apart.

10. The dual-band diversity antenna of claim 1, wherein the high band main antenna and the low band main antenna are driven from a common port.

11. The dual-band diversity antenna of claim 1, wherein the high band diversity antenna and the low band diversity antenna are driven from a common port.

12. The dual-band diversity antenna of claim 1, wherein the reflector element is spaced about one third of a wavelength from radiating elements of the high band main antenna.

13. The dual band diversity antenna of claim 1, wherein the high band diversity antenna is capacitively coupled to the ground plane.

14. The dual band diversity antenna of claim 13, wherein the high band diversity antenna is conductively coupled to the ground plane.

15. The dual band diversity antenna of claim 1, wherein the high band diversity antenna is conductively coupled to the ground plane.

16. A communication device configured to provide a host computing device with wireless communication capability, the communication device comprising:

a housing; and dual-band diversity antenna disposed in the housing, the dual band diversity antenna including:

a ground plane;

a first antenna system coupled to the ground plane and including elements that are configured as a half-wave dipole for operation in a high band as a high band main antenna, the high band main antenna being configured for driving in a differential mode and including a reflector element operative to provide directionality and beam reinforcement, the first antenna system further including elements that are configured as a dipole for operation in a low band as a low band main antenna, the low band main antenna being configured for driving in a differential mode and including a quarter-wave structure to which the low band main antenna dipole is coupled; and a second antenna system coupled to the ground plane and including elements that are configured as a dipole for operation in a high band as a high band diversity antenna, the high band diversity antenna being configured for driving in a common mode, the second antenna system further including elements that are configured as a dipole for operation in a low band as a low band diversity antenna, the low band diversity antenna having the ground plane as a counterpoise.

17. The communication device of claim 16, wherein the high band main antenna is inductively coupled to the ground plane.

18. The communication device of claim 16, wherein the quarter-wave structure is end-loaded with two end-loading structures.

19. The communication device of claim 18, wherein the end-loading to the two end-loading structures is by way of meander lines.

20. The communication device of claim 18, wherein the two end-loading structures are capacitively coupled to the ground plane.

21. The communication device of claim 20, wherein the capacitive coupling is asymmetrical.

22. The communication device of claim 16, wherein the first antenna system includes a balun through which differential driving of the low band main antenna is effected.

23. The communication device of claim 16, wherein the high band diversity antenna includes two top-loading sections.

24. The communication device of claim 23, wherein the two top-loading sections are about a third of a wavelength apart.

25. The communication device of claim 16, wherein the high band main antenna and the low band main antenna are driven from a common port.

26. The communication device of claim 16, wherein the high band diversity antenna and the low band diversity antenna are driven from a common port.

27. The communication device of claim 16, wherein the reflector element is spaced about one third of a wavelength from radiating elements of the high band main antenna.

28. The communication device of claim 16, wherein the high band diversity antenna is capacitively coupled to the ground plane.

29. The communication device of claim 28, wherein the high band diversity antenna is conductively coupled to the ground plane.

30. The communication device of claim 16, wherein the high band diversity antenna is conductively coupled to the ground plane.

* * * * *